United States Patent [19]

Carder, Sr.

[11] Patent Number: 4,487,238

[45] Date of Patent: Dec. 11, 1984

[54] NOZZLE HAVING IMPROVED LOW FLOW CHARACTERISTICS AND POPPET THEREFOR

[75] Inventor: Mervin L. Carder, Sr., Fenton, Mo.

[73] Assignee: M. Carder Industries, Inc., Fenton, Mo.

[21] Appl. No.: 416,299

[22] Filed: Sep. 9, 1982

[51] Int. Cl.[3] ..... B65B 3/26

[52] U.S. Cl. ..... 141/206; 141/217; 141/392; 251/77; 251/228

[58] Field of Search ..... 141/192, 198, 206, 209, 141/217, 218, 225, 226, 205, 46, 59, 294, 354, 301, 302, 392; 251/77, 78, 228, 251, 298, 339

[56] References Cited

U.S. PATENT DOCUMENTS

| | | | |
|---|---|---|---|
| 3,242,938 | 3/1966 | Smilg et al. | 251/77 |
| 3,330,479 | 7/1967 | Vollprecht | 251/77 |
| 3,817,285 | 6/1974 | Wilder et al. | 141/206 X |
| 3,823,752 | 7/1974 | Lasater et al. | 141/217 |
| 3,877,480 | 4/1975 | Hughes et al. | 251/321 |
| 4,397,447 | 8/1983 | Fink, Jr. | 141/206 |

*Primary Examiner*—Stephen Marcus
*Assistant Examiner*—Ernest G. Cusick
*Attorney, Agent, or Firm*—Polster, Polster & Lucchesi

[57] ABSTRACT

A fluid dispensing nozzle for gasoline or the like includes a valve seat, a poppet valve for controlling flow through the valve seat, a spring urging the poppet valve closed, a valve stem extending into the poppet valve, a handle engaging the valve stem for manually urging the poppet valve away from its seat and a high-level shut-off means for disabling the handle. The poppet valve assembly is constructed to lift one side of the poppet when the handle is initially lifted.

20 Claims, 8 Drawing Figures

NOZZLE HAVING IMPROVED LOW FLOW CHARACTERISTICS AND POPPET THEREFOR

BACKGROUND OF THE INVENTION

This invention relates to a dispensing nozzle of the type used for dispensing gasoline or the like. Gasoline dispensing nozzles conventionally include a casing having an inlet, an outlet spout, and a poppet valve for controlling flow between the inlet and outlet spout. The poppet includes a sealing disk for shutting off flow when the valve is closed and a depending tapered skirt for modulating the flow through its associated valve seat as the poppet is raised and lowered. The poppet is urged downwardly against its seat by a spring. A valve stem, which is operated by a manually operated lever or handle, extends into the poppet valve and opens the poppet valve against the force of the spring. An automatic shut-off assembly forms a pivot for the lever; when the tip of the spout is submerged, the shut-off assembly shifts the pivot point and prevents the lever from moving the valve stem. This construction is well known in the art and is described in my U.S. Pat. No. 3,757,834 and in Lawrence et al, U.S. Pat. No. 3,877,480, for example.

Presently known gasoline dispensing nozzles were designed to enable the user to stop flow "on the penny". Unfortunately, the quantity of gasoline represented by that penny has become so small that these nozzles are no longer able to provide that kind of control, because they can not handle such extremely low flow rates. Moreover, the nozzles are now frequently used on self-service gasoline pumps, and the persons using them are not generally highly skilled at the delicate operation of the nozzle. As a result, most self-service customers tend to overshoot the amount of gasoline they intend to put into their gasoline tanks by a penny or two, and the service station tends to round off the charge to the lower amount. Over the course of time, the cumulative loss to the service station can be quite substantial.

Several attempts have been made to modify existing gasoline dispensing nozzles to provide better low-flow characteristics.

One approach has been to change the casting and poppet to provide a smaller cross-section to the opening defined by the valve seat. This approach does not greatly improve the low-flow characteristics, and instead merely reduces the available high-flow rate.

Another approach has been to modify the shape of the poppet valve skirt to provide a greater difference between the diameter of the upper part of the skirt, for controlling low flow, and the diameter of the lower part of the skirt, for controlling high flow. This approach requires maintaining close tolerances in both the size of the poppet skirt and the size of the valve seat, and has also not been very effective.

Another approach has been to modify the valve stem. By reducing the diameter of the upper end of the stem, thereby creating a shoulder on the stem, a plastic sleeve has been mounted on the upper end of the stem. This sleeve carries a small wing which engages a lower face of the poppet. As the stem is raised by the manual lever, the wing lifts one side of the poppet. This design has been used in a nozzle produced by Emco Wheaton Inc. of Conneaut, Ohio (the general form of which is shown in Billian, U.S. Pat. No. 3,196,908), but it is not applicable to more common gasoline dispensing nozzles, such as the nozzle commonly designated as a type "1A", illustrated in Lawrence et al, U.S. Pat. No. 3,877,480, for example.

SUMMARY OF THE INVENTION

One of the objects of this invention is to provide a gasoline dispensing nozzle which provides highly precise low-flow control.

Another object is to provide such a gasoline dispensing nozzle which requires a low initial valve opening pressure.

Another object is to provide such a gasoline dispensing nozzle which provides all of the advantages of existing nozzles at normal flow rates.

Another object is to provide such a gasoline dispensing nozzle which is long-lasting and easy to repair.

Another object is to provide such a gasoline dispensing nozzle which may differ from commonly-used nozzles only in the design of the poppet valve, and therefore requires no modification of existing nozzle castings, handles, valve stems, or other parts.

Another object is to provide a novel poppet valve assembly which may be installed in an otherwise standard gasoline dispensing nozzle, thereby greatly improving the nozzle performance.

In accordance with this invention, generally stated, a gasoline dispensing nozzle is provided which includes a casing having an inlet, an outlet spout, a fluid passage therebetween, and a valve seat in the fluid passage, a poppet valve cooperative with the valve seat for closing the fluid passage, biasing means for biasing the poppet valve to a closed position, a valve stem depending from the poppet valve, a manually operable lever cooperative with the valve stem for opening the poppet valve against the bias of the biasing means, and automatic shut-off means for disabling the manually operable lever, characterized in that the poppet valve includes an upper part and a mating lower part extending into the upper part. The upper part comprises a sealing disk, means for holding the sealing disk for cooperation with the seat to close the fluid passage, means cooperative with the biasing means for urging the sealing disk into cooperation with the seat, and an upwardly extending central cavity in its lower face. The lower part comprises a central button extending into the central cavity of the upper part and a central socket for receiving an upper end of the valve stem. The cavity and the button are constructed to lift the upper part at an angle with respect to the plane normal to the stem, so as to lift one side of the sealing disk from the valve seat before the other side is lifted. In the preferred embodiments, a downwardly facing wall of the central cavity in the upper part and an upwardly facing wall of the button in the lower part form mating surfaces, at least one of which is canted at an angle on the order of about three to ten degrees from the plane normal to the stem, preferably about five degrees from that plane. The cavity preferably forms a loose sliding fit with the button, so as to maintain the upper and lower parts of the poppet in alignment with each other, with the spring and with the valve stem, while permitting the upper part to rock freely with respect to the lower part.

DESCRIPTION OF THE PREFERRED EMBODIMENTS

Figure 1:
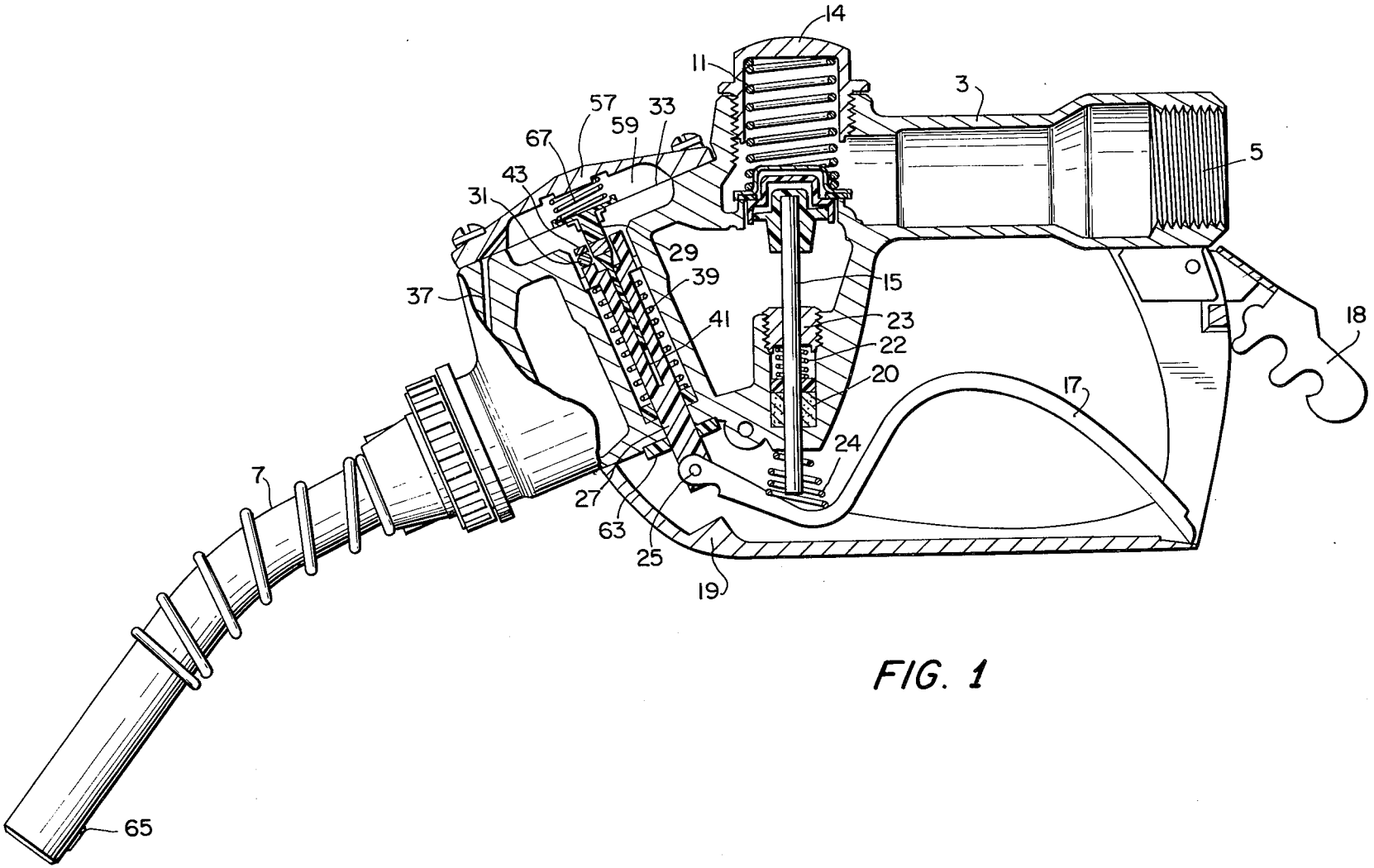
FIG. 1 is a view in right side elevation, partially broken away, of a gasoline nozzle in accordance with one preferred embodiment of the present invention.
Figure 2:
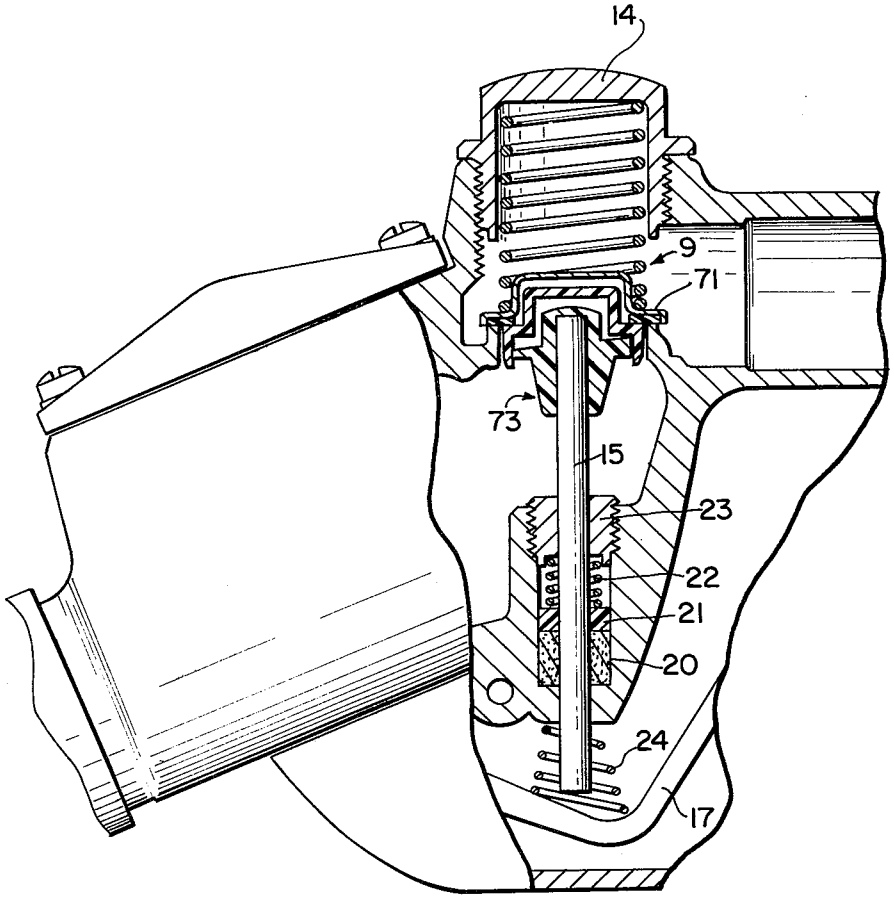
FIG. 2 is a cross-sectional detail of the nozzle of FIG. 1, showing a poppet assembly in accordance with my invention in a closed position.

Referring now to the drawings, and in particular to FIGS. 1–4, reference numeral 1 indicates a gasoline dispensing nozzle incorporating my invention. The nozzle 1 is of the general type known in the art as a "type 1A" nozzle. The nozzle 1 includes a casing 3 having a passage through it including an inlet 5 and an outlet 7. Inlet 5 is threaded to receive a flexible hose or the like from a gasoline pump, and the outlet 7 includes a spout adapted to be inserted into the fill tube of a vehicle gasoline tank. A main poppet valve assembly 9 constructed in accordance with my invention is urged by a poppet spring 11 against a cooperating valve seat 13 to close the passage through the casing 3. The poppet spring 11 is held in a casing cap 14 threaded into the top of the casing 3. A stem 15 extending from the lower end of the valve 9 is slidably mounted in the casing 3. The poppet assembly 9 is described in detail hereinafter.

The lower end of the stem 15 is engaged by a manually operable lever 17 which is normally suitably pivoted to lift the main valve 9 from its seat 13 when the lever 17 is lifted. Suitable hold-open means in the form of a clip 18 are preferably provided on a cast hand guard 19 for engaging a rearward end of the lever 17, although many self-service nozzles omit any hold-open device. The central part of the lever 17 is upwardly bowed to form a hand hold.

The lower portion of the stem 15 passes through the casing 3, through a sliding seal consisting of packing 20, held by a packing gland 21, held by a packing spring 22, held by a packing nut 23 threaded into the casing 3. A lever hold-down spring 24 encircles the lower portion of the stem 15, between the stem 15 and a portion of the lever 17 between the hand hold and the forward end of the lever. The hold-down spring 24 holds the lever 17 against the hand guard 19 when the nozzle is not in use.

The forward end of the lever 17 is held by a pivot pin 25 to the lower end of a cylindrical plunger 27 which is mounted for reciprocation in the casing 3. The plunger 27 forms a part of an automatic shut-off system for shutting off the flow of gasoline through the nozzle when the level of gasoline in the tank being filled reaches the end of the spout. The shut-off system includes the plunger 27, a latch pin 29, three latching balls 31, a diaphragm 33, a venturi means, and a breather tube. The plunger 27 is conventionally made of plastic, the commercially preferred plastic being a homopolymer acetal resin sold by E. I. DuPont de Nemours & Company, Inc. under the trade name Delrin, which has a low coefficient of friction, dimensional stability and resistance to attack by gasoline. A coil plunger spring 39 biases the plunger 27 upward. The latch pin 29 extends into a blind axial bore 41 in the upper end of the plunger 27. Three radial openings 43 extending from the outer surface of the cylindrical plunger 27 into the axial bore 41 act as guideways for the latching balls 31. The latch pin 29 is preferably of the form shown in my prior U.S. Pat. No. 3,757,834. The upper end of the latch pin 29 is secured to the center of the diaphragm 33. The periphery of the diaphragm 33 is secured to the casing 3 by a vacuum cap 57 and defines with the vacuum cap 57 a pressure chamber 59 in the casing. The pressure chamber 59 communicates with a hole 65 in the side of the spout through a passageway including the breather tube 37. A balance spring 67 on the upper side of the diaphragm 33 positions the latch pin and determines the sensitivity of the automatic shut-off system.

An annular collar 63 mounted on the plunger between the exterior of the casing and the end of the lever 17 limits the upward movement of the plunger 27 when the lever 17 is released.

As thus far described, the nozzle 1 is entirely conventional except for the poppet valve assembly 9, and is in widespread commercial use. Its operation is well known, and is described in the previously-mentioned patents. Briefly, when the handle 17 is lifted, the latch pin 29 and balls 31 hold the plunger 27 in its upward position, and the handle lifts the valve 9 from the seat 13 to permit gasoline to flow through the nozzle casing 3. When the opening 65 in the nozzle becomes submerged, the decrease in pressure in chamber 59 causes the latch pin to be pulled upward, and the plunger 27 is released. Because the poppet spring 11 is far stronger than the plunger spring 39, the valve system 15 forces the plunger 27 and the lever 17 down and the valve assembly 9 closes.

In accordance with the present invention, the valve assembly 9 is constructed to facilitate cracking the poppet valve open with very little operating force and to provide very low and very precise flow rates without sacrificing available maximum flow rates. The improved valve assembly also may be substituted for a conventional poppet valve without further modification of the nozzle. As is well known, the valve seat of a type 1A nozzle includes a cylindrical (straight sided) wall 68 having an upper bearing surface 69 on which the poppet disk seals. The poppet valve skirt extends into the cylindrical valve seat and modulates the flow of gasoline through the valve seat.

A first embodiment of the poppet assembly 9 is shown in FIGS. 1–5. In this embodiment, the poppet valve includes an upper part 71 and a mating lower "pusher" part 73 extending into the upper part 71.

The upper part 71 is formed in three parts: a valve cap 75, a skirt part 77 and a sealing disk 79.

The valve cap 75 is identical with the valve cap commonly utilized with type 1A nozzles. It is formed of sheet metal and includes a central boss 81 and a peripheral flange 83. The flange 83 is turned down at its periphery to form a lip 85.

The skirt part 77 is molded of Delrin and includes a central head 87, a peripheral shoulder 89 and a depending skirt 91. The outside surface of the head 87 forms a sliding fit with the inside surface of the boss 81 of the cap 75. The outside surface of the depending skirt 91 is tapered at an angle of five degrees; this angle is substantially the same as that conventionally used in the poppet assembly of a type 1A nozzle, and extensive experimentation has indicated that it is also the optimum for use in the improvement of the present invention. The lower face of the skirt part 77 includes a central cavity 93. The cavity 93 includes a central recess 95 extending into the head 87, a downwardly facing peripheral land 97 and a peripheral wall 99. The peripheral land 97 is perpendicular to the vertical axis of the central cavity 93.

The sealing disk 79 is also identical with the sealing disk of the standard type 1A nozzle. It is conventionally made of Buna-N rubber. In this embodiment, the disk 79 is trapped between the shoulder 89 of the skirt part 77 and the peripheral flange 83 of the cap part 75. The lip 85 of the cap part 75 centers the disk 79.

The lower part 73 includes a button part 101 and a socket part 103.

The button part 101 includes a central protuberance 105 and a peripheral rim 107. The central protuberance 105 has a rounded upper surface, and is formed substantially smaller in diameter than the central recess 95 in the skirt part 77. The height of the central portuberance 105 over the peripheral rim 107 is less than the depth of the central recess 95 in the skirt part 77. The peripheral rim 107 has a diameter just less than the diameter of the inner wall 99 of the cavity 93 in the skirt part 77, so as to provide a loose sliding fit between the wall 99 and the rim 107. This fit permits canting of the upper part 71 with respect to the pusher part 73 and yet aligns these parts. The peripheral rim 107 has an upwardly facing surface 109 which is canted from the horizontal (i.e., from a plane perpendicular to the vertical axis of the socket part 103) at an angle of five degrees. The socket part 103 includes an upwardly extending bore 111 which extends into the protuberance 105 above the rim 107. The bore 111 forms a snug sliding fit with the valve stem 15, and the top of the stem 15 engages the top of the bore 111.

Figure 3:
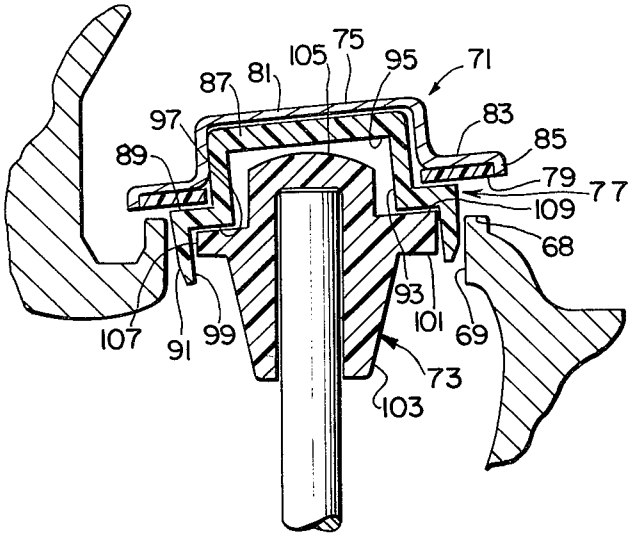
FIG. 3 is a cross-sectional detail corresponding to FIG. 2, showing a poppet assembly in accordance with my invention in an open position.

In operation, when the lever 17 is lifted, the lever hold-down spring 24 is easily compressed, and the lever 17 engages the lower end of the poppet valve stem 15. The upper end of the stem 15 lifts the pusher part 73. Therefore, as the lever 17 is raised farther, the high side of the upwardly facing surface 109 of the rim 107 of the pusher part 73 engages the downwardly facing land 97 in the cavity 93 of the upper skirt part 77. As the lever 17 is raised farther, the pusher part 73 lifts one side of the skirt part 77, hence the valve disk 79, against the bias of the poppet spring 11 until the upper part 71 is canted at an angle of five degrees from the valve seat and the mating surfaces 97 and 109 are in engagement, as shown in FIG. 3. This movement requires far less force than lifting the poppet valve straight up against the force of the spring 11. Therefore, cracking the valve 9 open is far easier than in a standard type 1A nozzle, and low-flow rates are easily and precisely controlled. As the lever 17 is lifted farther, the pusher part 73 and upper part 71 are raised vertically as a unit.

As the valve assembly 9 is opened, the amount of clearance between the skirt 91 and the cylindrical valve seat wall is slightly less than in a conventional nozzle, because of the canting of the valve assembly 9. This effect also aids in controlling the flow through the nozzle at low flow rates. As the valve assembly 9 is raised, however, the taper of the skirt 91 permits greater flow. At full flow the skirt is raised substantially above the seating surface 69 of the valve seat and permits as high a flow rate as a standard type 1A nozzle.

It will be seen that the depth of the socket part 103, the fact that the bore 111 extends into the central protuberance 105, the circumferential contact of the mating surfaces 97 and 109, and the loose but close fit between the rim 107 and inner wall 99 all provide great stability and strength to the assembly 99.

No modification of the poppet spring 11, poppet valve stem 15, or poppet valve cap 75 is required in the embodiment of FIGS. 1–5.

Figure 7:
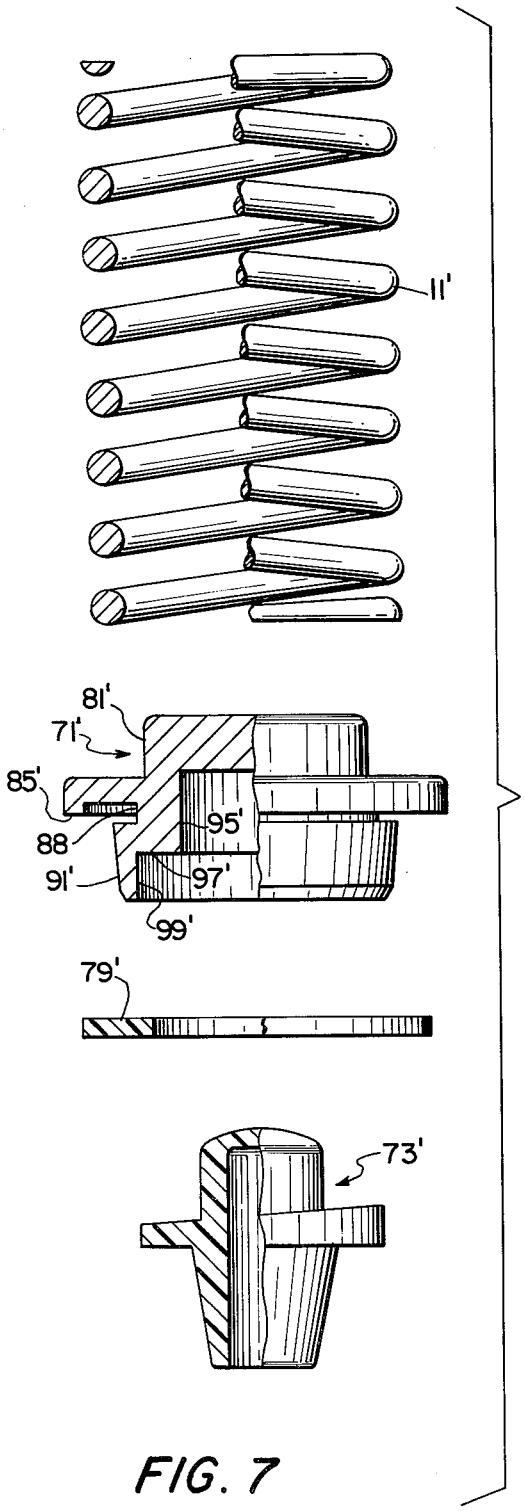
FIG. 7 is an exploded view, partly in cross section, of the valve assembly of FIG. 6.
Figure 4:
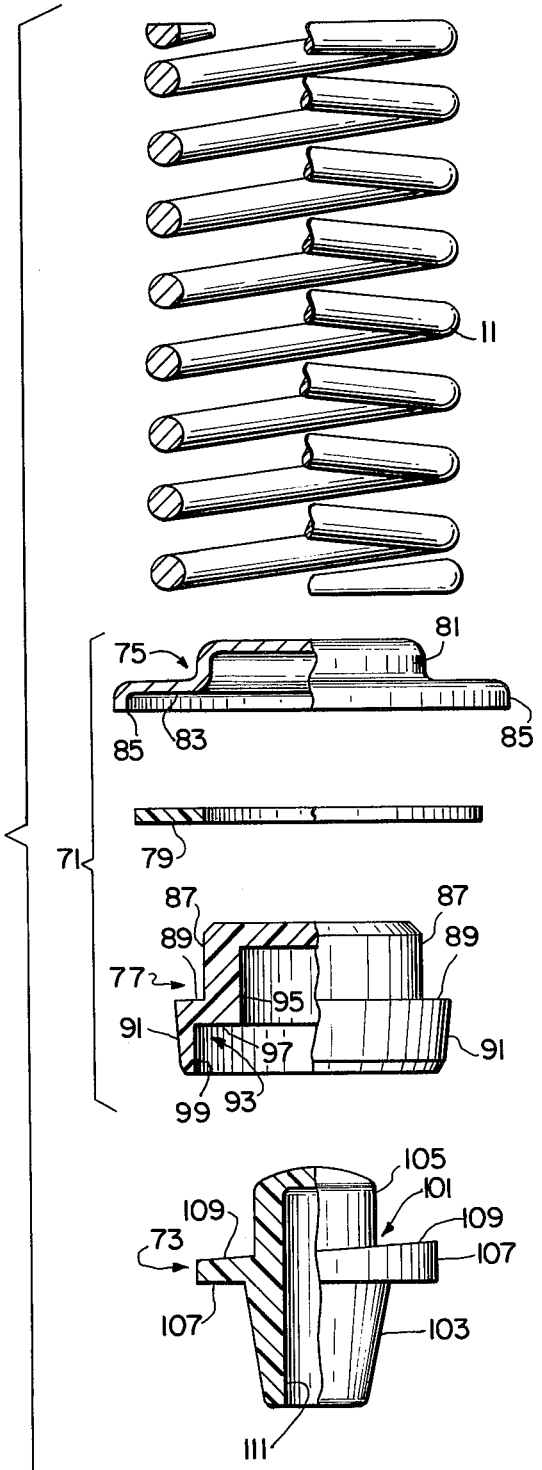
FIG. 4 is an exploded view, partly in cross section, of the valve assembly of FIGS. 1–3.
Figure 5:
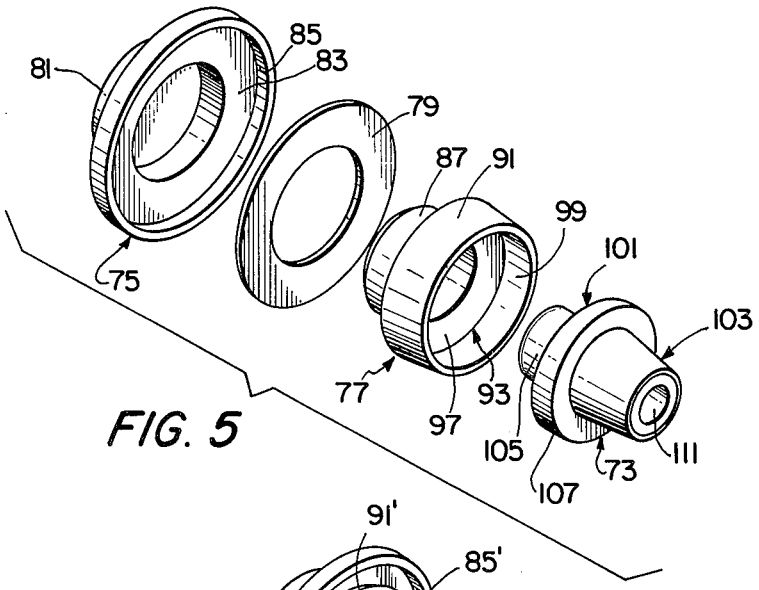
FIG. 5 is an exploded view in perspective of the valve assembly of FIGS. 1–4.
Figure 8:
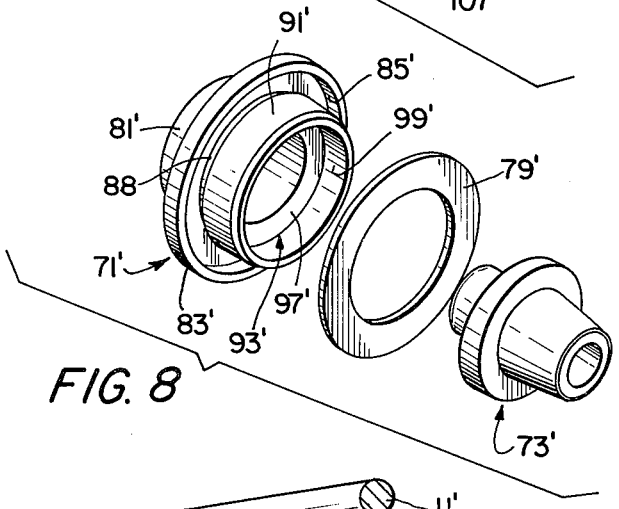
FIG. 8 is an exploded view in perspective of the valve assembly of FIGS. 6 and 7.
Figure 6:
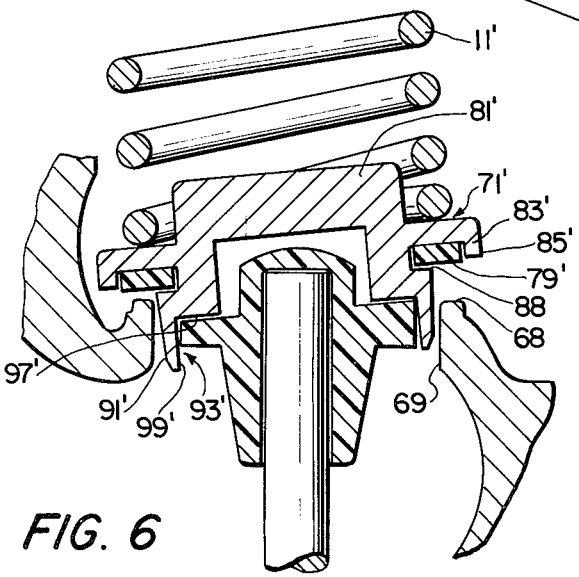
FIG. 6 is a cross-sectional detail corresponding to FIG. 3, showing a second embodiment of poppet assembly in accordance with my invention in an open position.

In the embodiment of FIGS. 6–8, the upper part 71' of the poppet valve assembly 9 of the first embodiment is modified by combining the cap and skirt parts and slightly modifying the sealing disk. No other changes are required in the nozzle of this second embodiment.

In the embodiment of FIGS. 6–8, the upper part 71' is cast of aluminum and includes a central boss 81', a peripheral flange 83' turned down at its periphery to form a lip 85', an undercut annular groove 88 for receiving the poppet disk 79', a depending skirt 91' tapered at an angle of five degrees, and a central cavity 93' in the lower face of the upper part 71'. The cavity 93' is of the same dimensions as the cavity 93 of the first embodiment and includes a central recess 95', a downwardly facing peripheral land 97' and a peripheral wall 99'. The peripheral land 97' is perpendicular to the vertical axis of the central cavity 93'.

The sealing disk 79' of this embodiment differs from the disk 79 of the first embodiment only in that its inner diameter is slightly less, to permit its easy installation in the groove 88.

The pusher part 73' of this embodiment is identical with the pusher part 73 of the first embodiment.

The operation of the nozzle of this embodiment is identical with the operation of the nozzle of the first embodiment.

It will be seen that the second embodiment of nozzle of the invention requires fewer parts and provides a more secure mounting for the poppet disk, but that it requires a special cast aluminum part.

Numerous variations in the nozzle and poppet assembly of the present invention, within the scope of the appended claims, will occur to those skilled in the art in light of the foregoing disclosure. For example, the angle at which the skirt is tapered and the angle at which the rim is canted may be varied somewhat, although angles of about five degrees for each appear to provide substantially improved results. The rim of the pusher part may be formed perpendicular to the axis of the valve stem and the peripheral land of the cavity in the upper valve part may be canted. The skirt may be formed on the pusher part, although this arrangement sacrifices some of the advantages of the preferred embodiments. These variations are merely illustrative.

I CLAIM:

1. A dispensing nozzle for gasoline or the like including a casing having an inlet, an outlet spout, a fluid passage therebetween, and a valve seat in the fluid passage, a poppet valve assembly cooperative with the valve seat for closing the fluid passage, biasing means for biasing the poppet valve assembly to a closed position, a valve stem depending from the poppet valve assembly, a manually operable lever cooperative with the valve stem for opening the poppet valve assembly against the bias of the biasing means, and automatic shut-off means for disabling the manually operable lever, characterized in that the poppet valve assembly includes an upper part and a mating lower part extending into the upper part, the upper part comprising a sealing disk, means for holding the sealing disk for cooperation with the seat to close the fluid passage, means cooperative with the biasing means for urging the sealing disk into cooperation with the seat, a depending skirt tapered to form an increasingly large flow passage through said valve seat as said valve assembly is lifted, and an upwardly, extending central cavity in the lower face of the upper part, the lower part comprising a central button extending into the central cavity of the upper part and a central socket for receiving an upper end of the valve stem, the cavity and the button being constructed to lift the upper part at an angle with respect to the plane normal to the stem, so as to lift one side of the sealing disk from the valve seat before the other side of the sealing disk is lifted.

2. The nozzle of claim 1 wherein a downwardly facing wall of the central cavity in said upper part and an upwardly facing wall of the button in said lower part form mating surfaces, at least one of said mating surfaces being canted at an angle on the order of about three to ten degees from the plane normal to the stem.

3. The nozzle of claim 2 wherein said at least one mating surface is canted at an angle of about four to six degrees from the plane normal to the stem.

4. The nozzle of claim 2 wherein said upwardly facing wall of said button is canted at an angle on the order of about three to ten degrees from the plane normal to the stem.

5. The nozzle of claim 2 wherein said cavity forms a loose sliding fit with said button, so as to maintain the upper and lower parts of the poppet valve assembly in alignment with each other, with the biasing means, and with the valve stem, while permitting the upper part to rock freely with respect to the lower part.

6. The nozzle of claim 1 wherein the taper of said skirt is from about three to seven degrees.

7. The nozzle of claim 1 wherein the cavity in said upper part includes a central recess and a peripheral land, and wherein the button part of said lower part includes a central protuberance and a peripheral rim, said land and said rim forming said mating surfaces.

8. The nozzle of claim 1 wherein said upper part comprises a molded metal part having a groove formed therein for said sealing disk.

9. The nozzle of claim 1 wherein said upper part includes a molded plastic part and a separate cap part, said sealing disk being trapped between said molded plastic part and said cap part.

10. A dispensing nozzle for gasoline or the like including a casing having an inlet, an outlet spout, a fluid passage therebetween, and a valve seat in the fluid passage, a poppet valve assembly cooperative with the valve seat for closing the fluid passage, biasing means for biasing the poppet valve assembly to a closed position, a valve stem depending from the poppet valve assembly, a manually operable lever cooperative with the valve stem for opening the poppet valve assembly against the bias of the biasing means, and automatic shut-off means for disabling the manually operable lever, characterized in that the poppet valve assembly includes an upper part and a mating lower part extending into the upper part, the upper part comprising a sealing disk, means for holding the sealing disk for cooperation with the seat to close the fluid passage, said means for holding the sealing disk comprising a molded plastic part and a separate cap part, said sealing disk being trapped between said molded plastic part and said cap part, means coooperative with the biasing means for urging the sealing disk into cooperation with the seat, and an upwardly extending central cavity in the lower face of the upper part, the lower part comprising a central button extending into the central cavity of the upper part and a central socket for receiving an upper end of the valve stem, the cavity and the button being constructed to lift the upper part at an angle with respect to the plane normal to the stem, so as to lift one side of the sealing disk from the valve seat before the other side of the sealing disk is lifted.

11. The nozzle of claim 10 wherein a downwardly facing wall (97) of the central cavity in said upper part and an upwardly facing wall (109) of the button in said lower part form mating surfaces, at least one of said mating surfaces being canted at an angle on the order of about three to ten degrees from the plane normal to the stem.

12. The nozzle of claim 11 wherein said upwardly facing wall of said button is canted at an angle of about four to six degrees from the plane normal to the stem.

13. The nozzle of claim 10 wherein said cavity forms a loose sliding fit with said button, so as to maintain the upper and lower parts of the poppet valve assembly in alignment with each other, with the biasing means, and with the valve stem, while permitting the upper part to rock freely with respect to the lower part.

14. The nozzle of claim 10 wherein said upper part comprises a depending skirt tapered three to seven degrees to form an increasingly large flow passage through said valve seat as said valve assembly is lifted.

15. The nozzle of claim 10 wherein the cavity in said upper part includes a central recess and a peripheral land, and wherein the button part of said lower part includes a central protuberance and a peripheral rim, said land and said rim forming said mating surfaces.

16. A poppet valve assembly for use in a dispensing nozzle for gasoline or the like, said poppet valve assembly including an upper part and a mating lower part extending into the upper part, the upper part comprising a sealing disk, means for holding the sealing disk for cooperation with a valve seat in said nozzle, means adapted to cooperate with a biasing means in said nozzle for urging the sealing disk into cooperation with the seat, a depending skirt tapered three to seven degrees to form an increasingly large flow passage through the seat as said valve assembly is lifted to move said sealing disk from the seat, and an upwardly extending central cavity in a lower face of the upper part, the lower part comprising a central button extending into the central cavity of the upper part and a central socket for receiving an upper end of the valve stem, the cavity and the button being constructed to lift the upper part at an angle with respect to the plane normal to the stem, so as to lift one side of the sealing disk from the valve seat before the other side of the sealing disk is lifted.

17. The poppet valve assembly of claim 16 wherein the cavity in said upper part includes a central recess and a peripheral land, and wherein the button of said lower part includes a central protuberance and a peripheral rim, said land and said rim forming mating surfaces, at least one of said surfaces being canted at an angle of about four to six degrees from the plane normal to the stem.

18. The poppet valve assembly of claim 16 wherein said cavity forms a loose sliding fit with said button, so as to maintain the upper and lower parts of the poppet valve assembly in alignment with each other and with the valve stem, while permitting the upper part to rock freely with respect to the lower part.

19. The poppet valve assembly of claim 16 wherein said upper part comprises a molded part having a groove formed therein for said sealing disk.

20. The poppet valve assembly of claim 16 wherein said upper part includes a molded plastic part and a separate cap part, said sealing disk being trapped between said molded plastic part and said cap part.

* * * * *